United States Patent [19]

Robinson

[11] Patent Number: 4,701,857

[45] Date of Patent: Oct. 20, 1987

[54] METHOD AND APPARATUS FOR CONTROLLING DRYERS FOR WOOD PRODUCTS, FABRICS, PAPER AND PULP

[76] Inventor: John W. Robinson, 108 Cypress St., Silsbee, Tex. 77656

[21] Appl. No.: 573,696

[22] Filed: Jan. 25, 1984

[51] Int. Cl.[4] ..... F26B 21/10; F26B 21/12

[52] U.S. Cl. ..... 364/477; 34/28; 34/46; 34/48; 34/52; 364/471

[58] Field of Search ..... 364/468, 471, 477, 557; 34/9.5, 26, 28, 41, 43, 48, 52, 25, 46

[56] References Cited

U.S. PATENT DOCUMENTS

| | | | |
|---|---|---|---|
| 3,807,055 | 4/1974 | Kraxberger | 34/46 X |
| 3,961,425 | 6/1976 | Swanson et al. | 34/52 |
| 4,038,531 | 7/1977 | Loe, Jr. | 364/418 |
| 4,095,645 | 6/1978 | Massey | 364/477 |
| 4,199,871 | 4/1980 | Ward et al. | 34/25 |
| 4,206,552 | 6/1980 | Pomerantz et al. | 364/477 |
| 4,255,869 | 3/1981 | Quester et al. | 34/25 |
| 4,314,878 | 2/1982 | Lee | 364/471 |
| 4,336,660 | 6/1982 | Strydom | 34/52 X |
| 4,356,641 | 11/1982 | Rosenau | 34/48 X |
| 4,373,364 | 2/1983 | Tanimoto et al. | 364/477 |
| 4,434,563 | 3/1984 | Graalmann et al. | 34/46 X |
| 4,494,315 | 1/1985 | Roos et al. | 34/52 X |
| 4,501,552 | 2/1928 | Wakamiya | 364/477 X |
| 4,513,759 | 4/1985 | Wochnowski et al. | 34/46 X |
| 4,555,858 | 12/1985 | Hegedus et al. | 34/48 X |

*Primary Examiner*—Jerry Smith
*Assistant Examiner*—Allen MacDonald

[57] ABSTRACT

A method of and apparatus for controlling dryers for wood products, fabrics, paper, and pulp is disclosed by measuring a temperature differential that relates to the difference between the temperature of the drying medium and that of the product as the product is traveling through the dryer to determine what the final moisture content will be and controlling the differential temperature or the speed of the product through the dryer or both to obtain the desired moisture content in the product leaving the dryer.

10 Claims, 15 Drawing Figures

FIG. 4
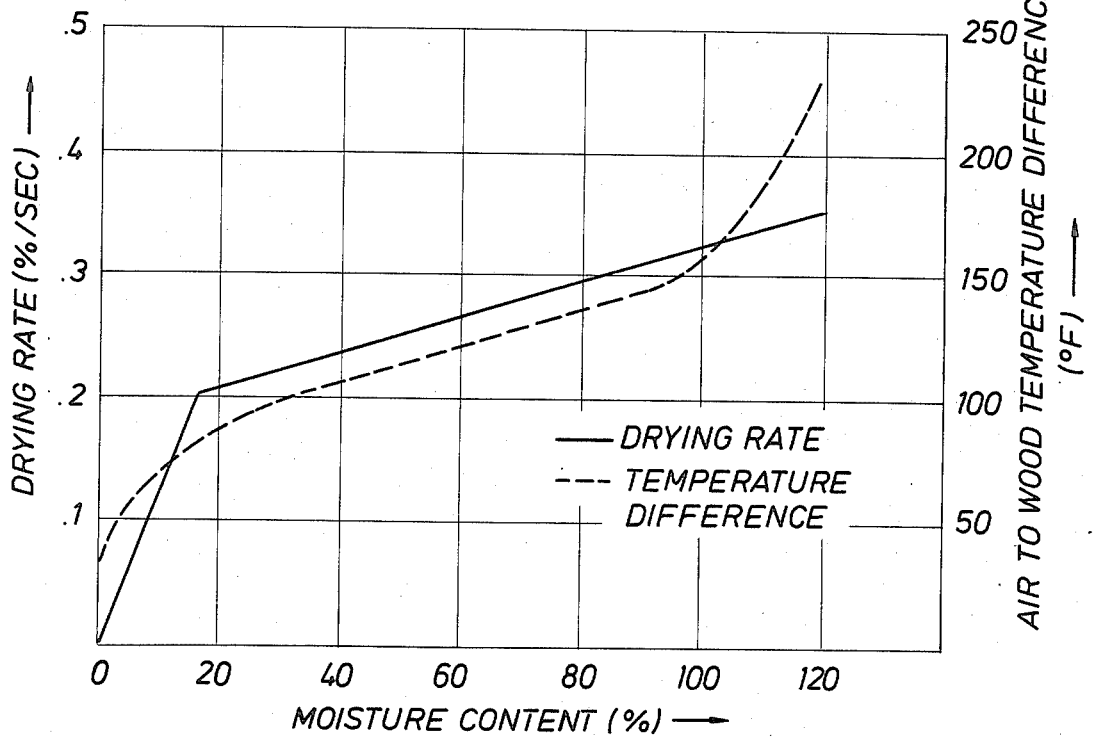
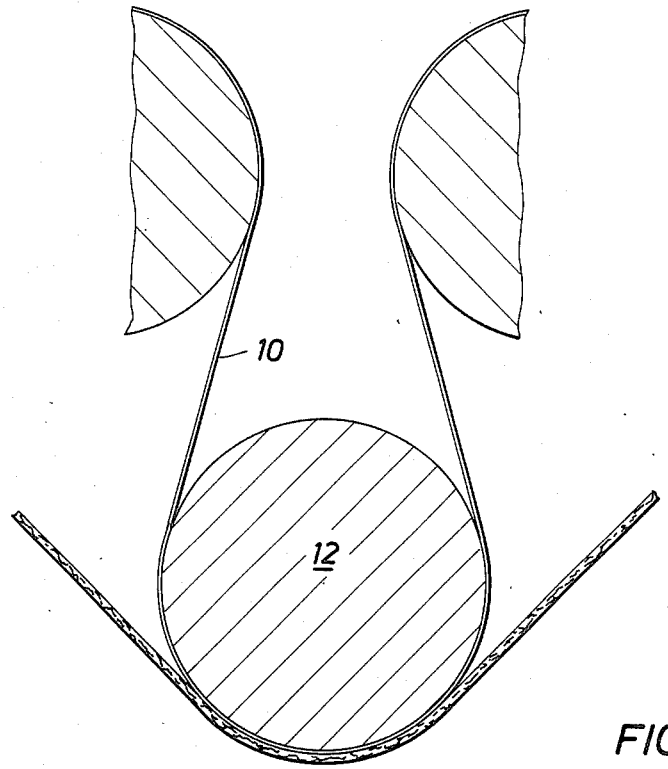
FIG. 7

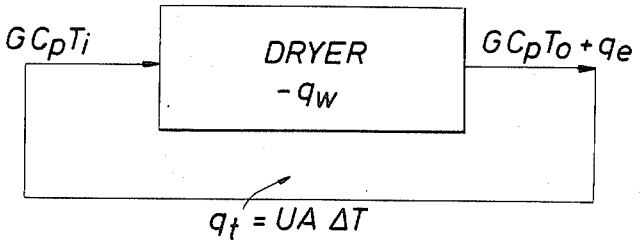
FIG. 8
FIG. 9
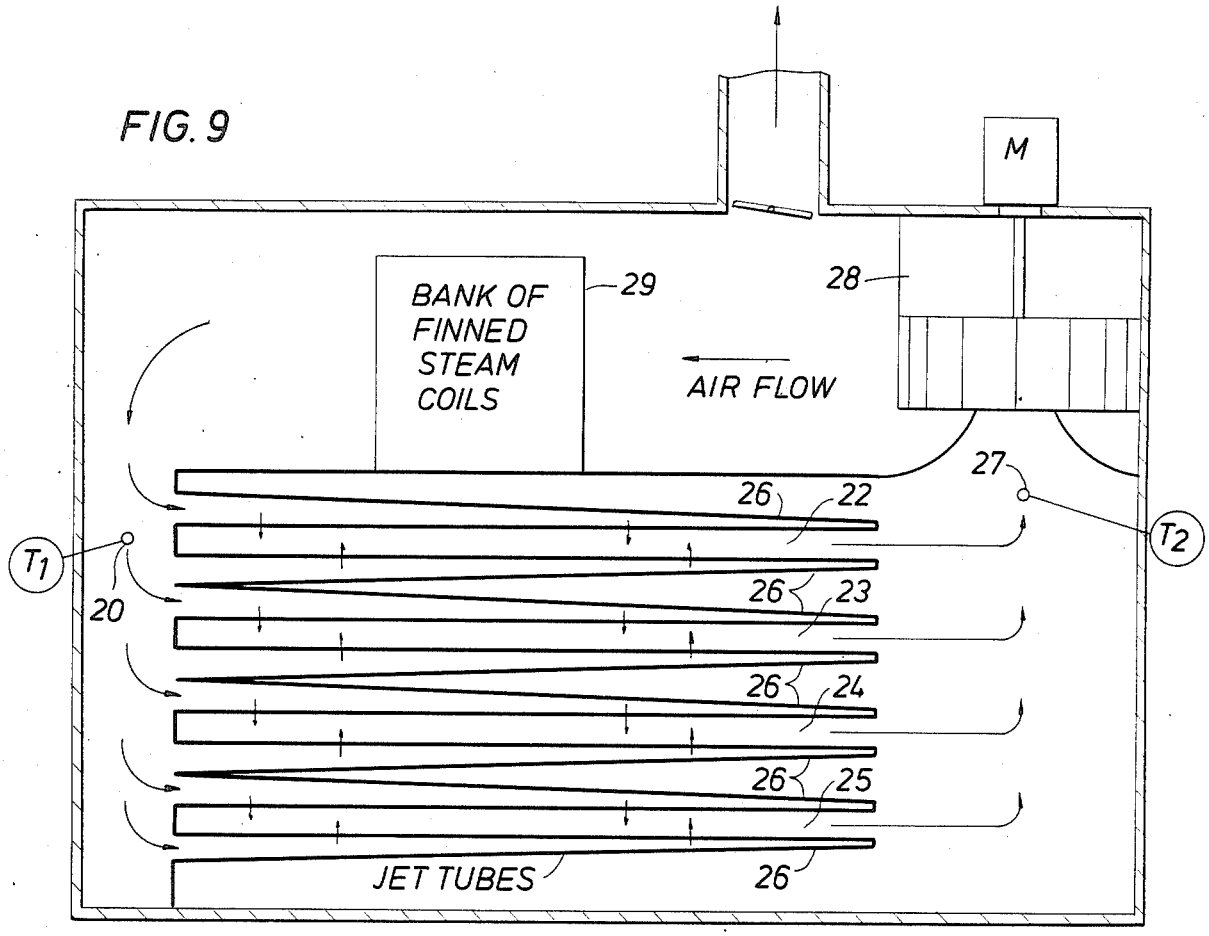
FIG. 10
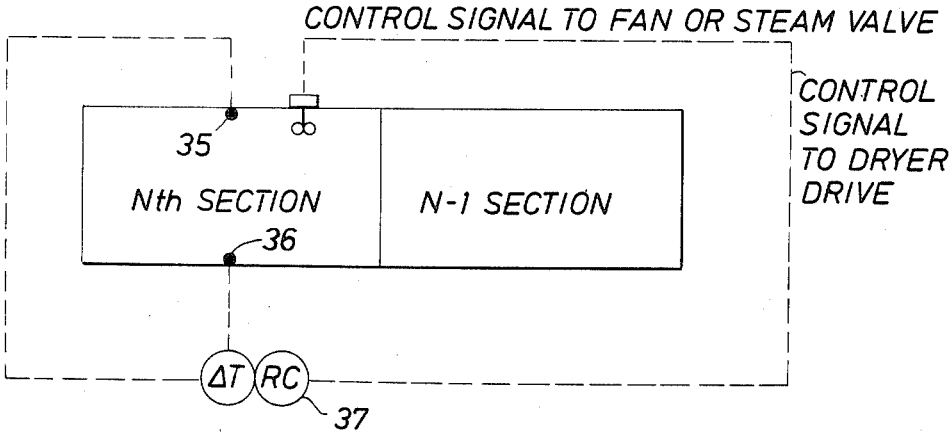

METHOD AND APPARATUS FOR CONTROLLING DRYERS FOR WOOD PRODUCTS, FABRICS, PAPER AND PULP

This invention relates to a method of and apparatus for controlling the operation of dryers for wood, fabrics, paper, pulp, fiberboards, and the like.

In most drying operations, the product being dried is contacted by a drying medium. In the case of wood, pulp, and fabrics, it is usually heated air. In the case of paper, it is usually a rotating heated drum that contacts the paper directly as the paper moves through the dryer. The variables that affect the moisture content of the dried product and that are usually monitored are: the wet and dry bulb temperatures of the heated air, the speed of the product through the dryer and steam pressure.

When drying wood products, such as veneer and fiberboard, since the moisture content of the wood varies as it enters the dryer, the distribution of the moisture content of the wood leaving the dryer resembles a bell curve as shown in FIG. 1.

As a result, some of the wood will be overdryed and will cause quality problems and some of the wood will be underdried requiring it to be dried again (redry). They both represent an economic loss, but at least the underdried wood can be salvaged. Therefore, the usual practice is to try to get an acceptable percentage of redry that will produce a minimum of overdried wood.

For example, when drying veneer, it is difficult, if not impossible, to monitor the moisture content of the veneer as it travels through the dryer, the common practice is for the operator of the dryer to control its operation based upon the percentage of redry coming out of the dryer. In other words, he will monitor the product and adjust the dryer speed accordingly. For example, if percent redry is too high, the dryer will be slowed down to produce more dry sheets. If percent redry is to low, the dryer will be speeded up to increase production of wet sheets. This is an "after the fact" type of adjustment, very inexact, and is essentially an inventory control system for percent redry.

Therefore, there is a need for a dryer control system that does not require the measurement or knowledge of such properties as initial or intermediate moisture content, wood species, specific gravity, thickness of the wood, and the percentage of heart and sap wood and it is an object of this invention to provide such a system.

It is another object of this invention to provide a method of and apparatus for controlling the operation of a dryer by monitoring two temperatures that can be readly measured in the dryer and using the difference between these temperatures to accurately predict what the moisture content of the product will be when it leaves the dryer. This allows the operation of the dryer to be adjusted while the product is being dried to produce the desired final moisture content in the case of paper, pulp, and fabric and the desired percentage of redry in the case of wood.

It is a further object of this invention to provide a method of and apparatus for controlling the operation of a dryer by measuring a temperature drop in the dryer that relates to the difference between the temperature of the drying medium and that of the product being dried to determine what the final moisture content of the product will be and adjusting the temperature difference by changing the heat input or the speed of the product through the dryer or both to obtain the desired final moisture content in the product.

It is a further object of this invention to provide a method of and apparatus for controlling the operation of a dryer in which the drying medium is hot air and the difference between the temperature of the air before it contacts the product and the temperature of the air after it has contacted the product is used to determine what will be the final moisture content of the product.

It is a further object of this invention to provide a method of and apparatus for controlling the operation of a dryer in which the drying medium is a heated cylinder and the difference between the temperature of the cylinder before it contacts the product and the temperature of the product after it has contacted the cylinder is used to determine what will be the final moisture content of the product.

These and other objects, advantages, and features of this invention will be apparent to those skilled in the art from a consideration of this specification including the attached drawings and appended claims.

FIG. 4 shows relationship of the drying rate and air to wood temperature gradient to moisture content with the solid line representing the drying rate and the dashed lines representing air to wood temperature gradient for 3/16 inch Douglas Fir, air temperature 400° F. and air velocity 5,000 fpm; (after Comstock)

Figure 2:
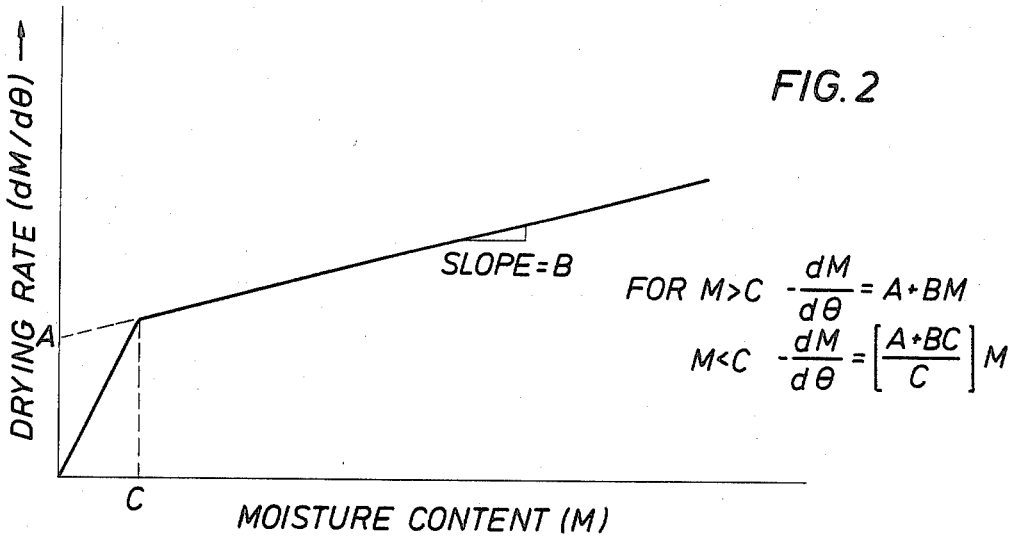
FIG. 2 is a graph of the straight line relationship between moisture content (M) and drying rate ($dm/d\theta$) previously believed to be valid; (after Comstock)
Figure 6:
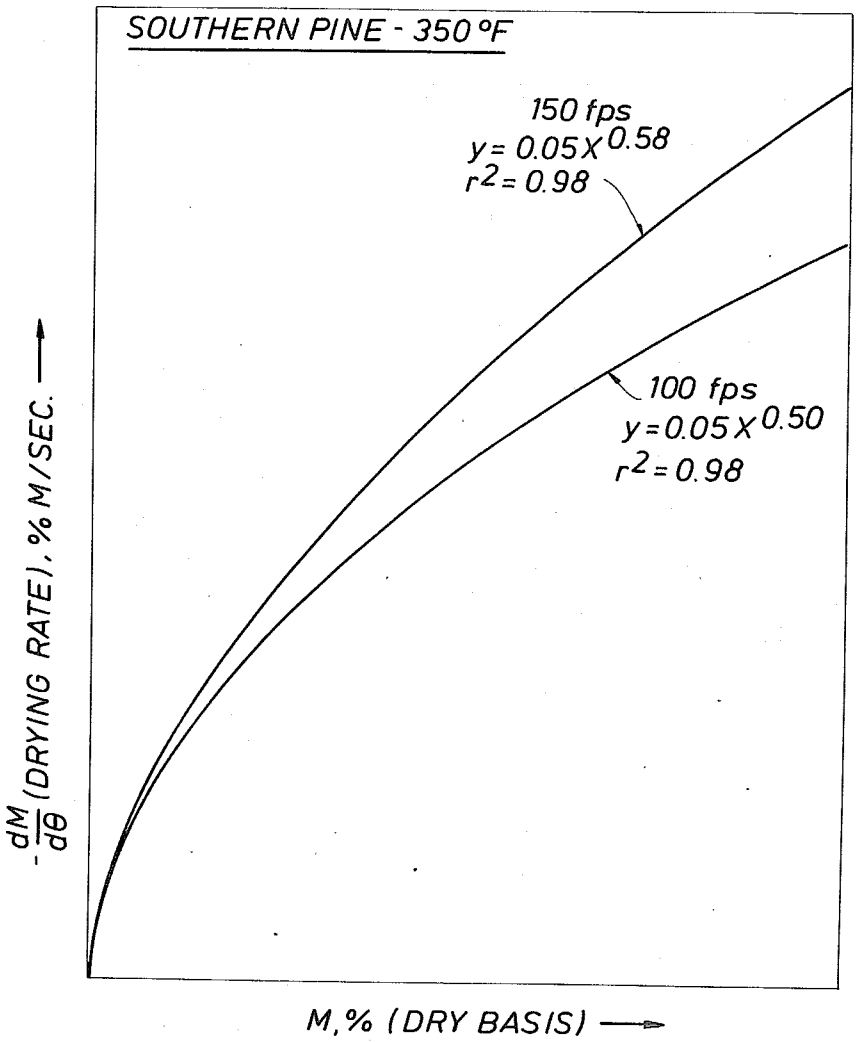
Figure 5:
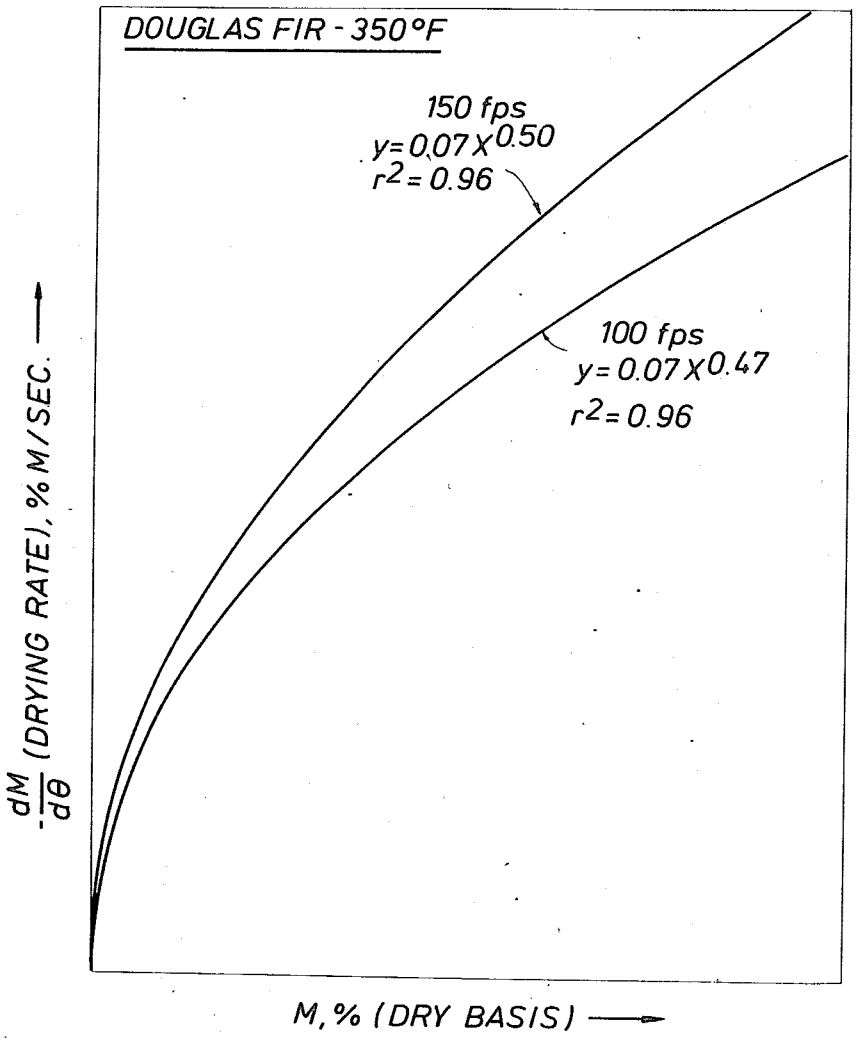
Figure 11:
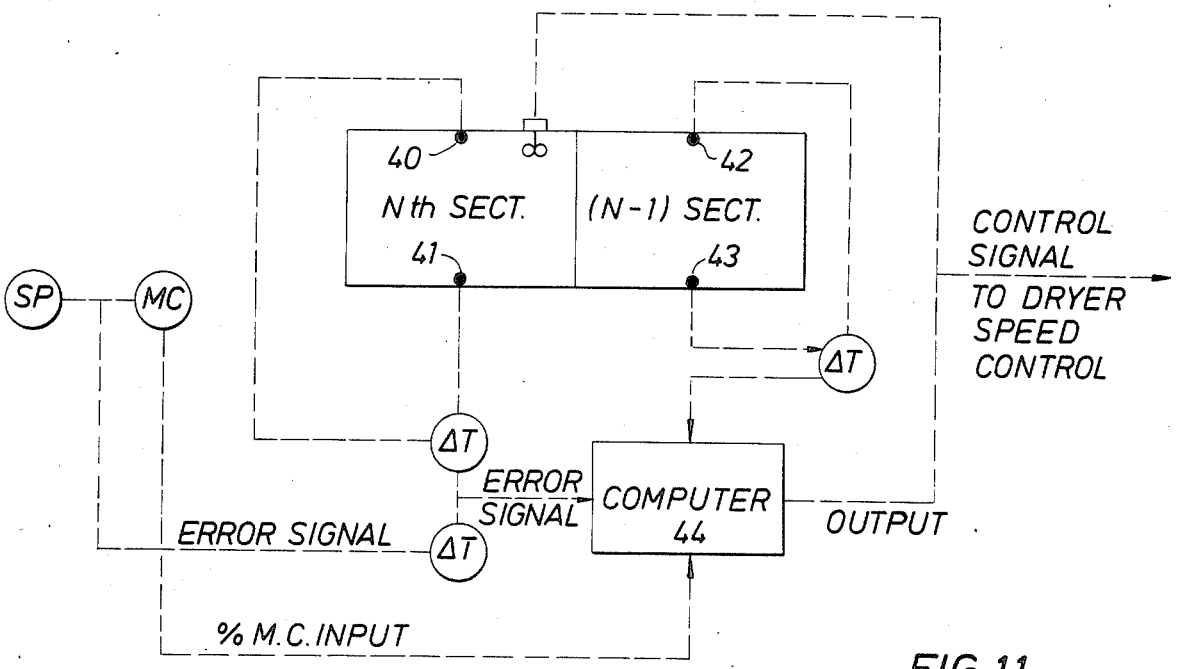
Figure 15:
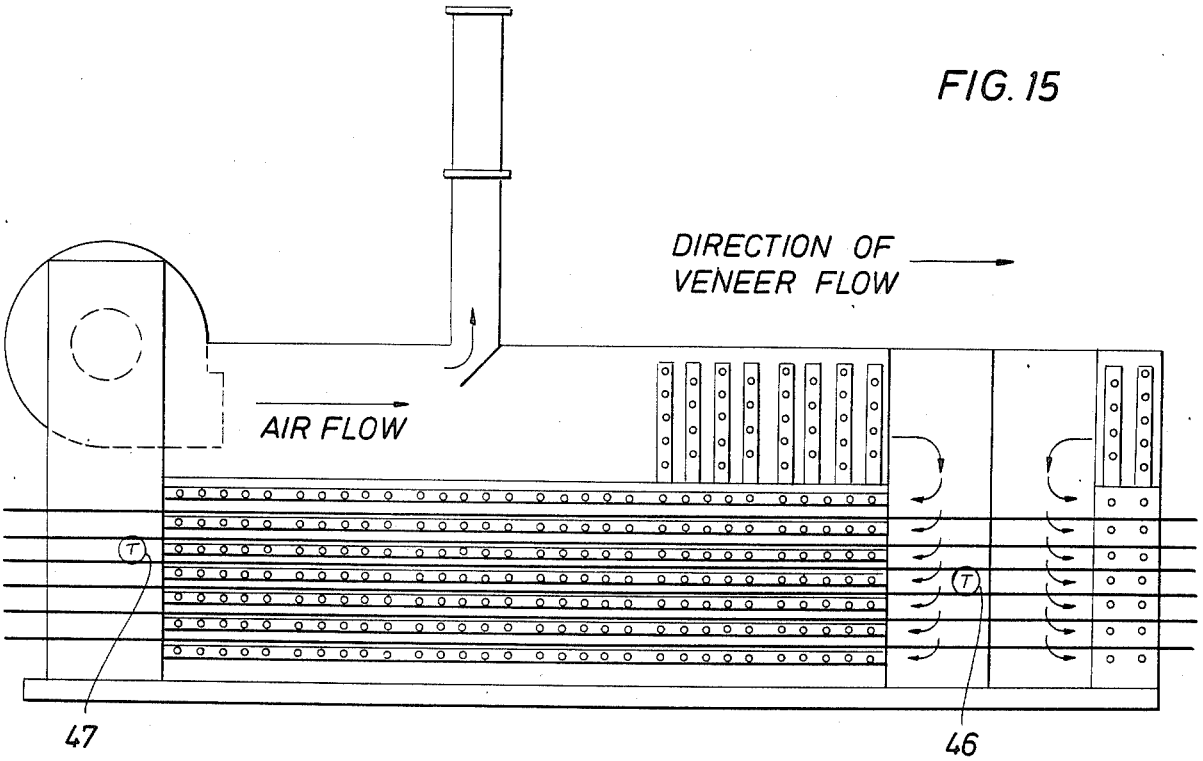
Figure 12:
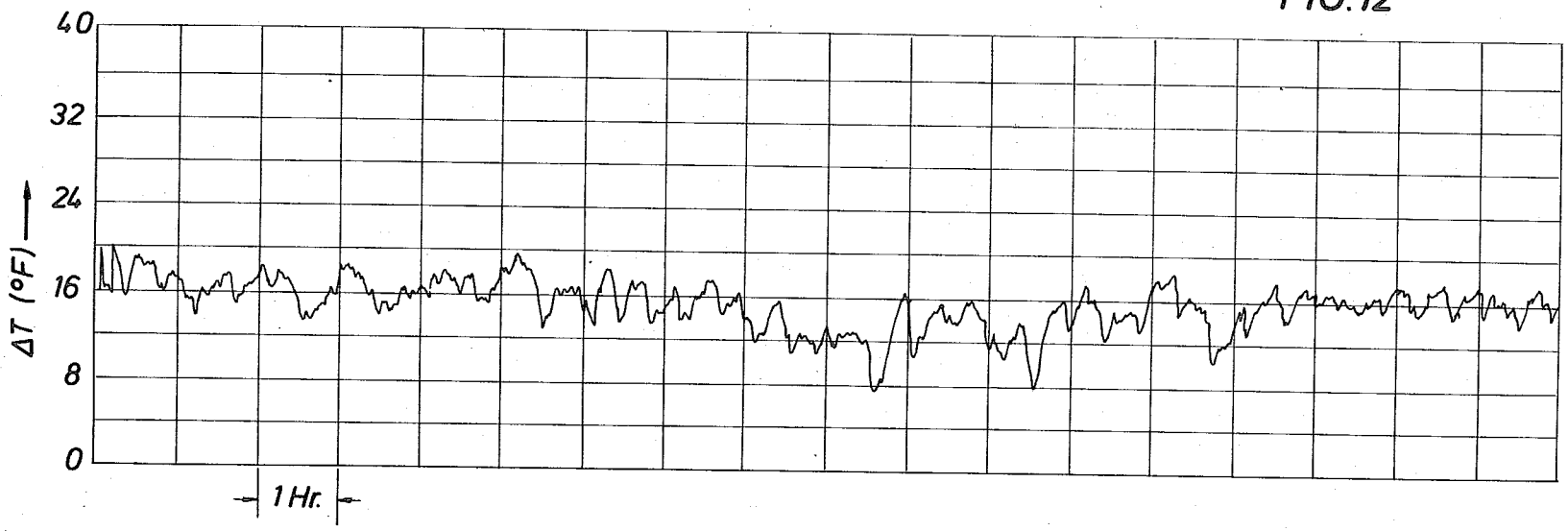
Figure 14:
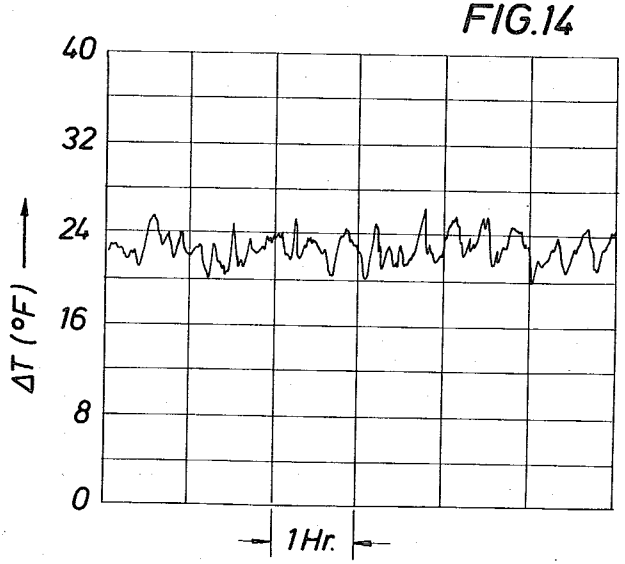
Figure 13:
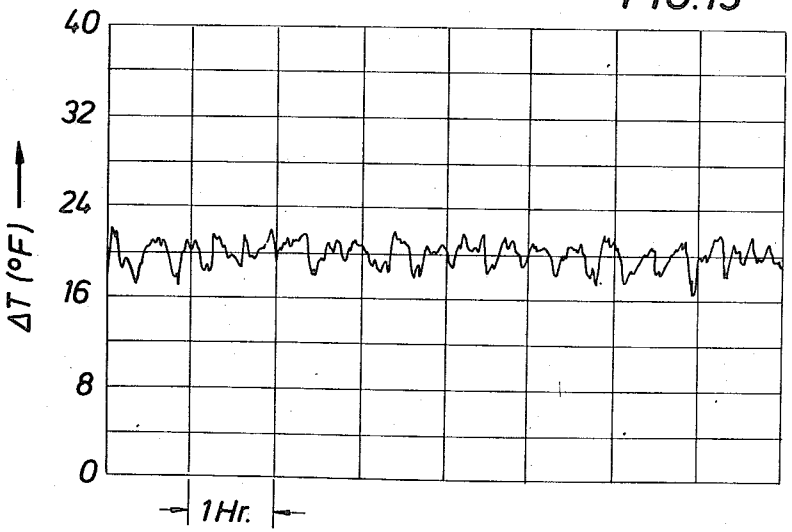

FIG. 5 is a graph of the relationship of moisture content, M, to the drying rate, $dm/d\theta$, for Douglas Fir dried under two different conditions;

FIG. 6 is a graph similar to FIG. 2 for Southern Pine;

FIG. 7 is a schematic diagram of a dryer for paper;

FIG. 8 shows an energy balance for a typical dryer section;

FIG. 9 is a cross-section of a steam heated jet dryer for veneer, fabrics, and the like;

FIGS. 10 and 11 are schematic diagrams of dryer control systems using this invention to control the moisture content of a dried product, such as veneer;

FIG. 12 is a strip chart recording of $\Delta T$ for a 24 section jet dryer, drying $\frac{1}{8}$ inch Southern Pine veneer without the control system of the invention;

FIGS. 13 and 14 are a strip chart recording of $\Delta T$ for the same 24 section dryer for $\frac{1}{8}$ inch (0.32 cm) and 1/6 inch (0.424 cm) Southern Pine veneer using the control system of this invention with $\Delta T$'s set at 20° F. and 22.8° F. respectively, and FIG. 15 is a sectional view of a longitudinal flow veneer dryer.

A lot of research has been done on drying wood, particularly veneer, and also paper and fabrics. For example see:

Bethel, J. S. and R. J. Hadar. 1952. "Hardwood Veneer Drying", *Journal of the Forest Products Research Society,* December 1952, pp 205–215.

Fleischer, H. O. 1953. "Drying Rates of Thin Sections of Wood at High Temperatures." Yale University: School of Forestry Bulletin, No. 59. p 86.

Comstock, G. L. 1971. "The Kinetics of Veneer Jet Drying", *Journal of the Forest Products Research Society,* Vol. 21, No. 9. pp 104–110.

Mulligan, F. N. and R. D. Davies. 1963. "High Speed Drying of Western Softwoods for Exterior Plywood", *Journal of the Forest Products Research Society,* Vol. 13, No. 1. pp 23–29.

South, Veeder III. 1968. "Heat and Mass Transfer Rates Associated with the Drying of Southern Pine and Douglas Fir Veneer in Air and in Steam at Various Temperatures and Angles of Impingement." M.S. Thesis. Oregon State University. p 61.

Hartley, F. T. and Richards, R. J., 1974, "Hot Surface Drying of Paper, The Development of a Diffusion Model", *Tappi,* Vol. 57, No. 3, pp 157–160.

Beckwith, W. F., Beard, J. N., Jr., and Gross, R. L., "The Optimization of Textile Tenter Frame Dryer Operations", The First Int. Symposium on Drying, *Science Press,* Princeton, Aug. 3–5, 1978.

All of this work is based on a straight line relationship between drying rate, $dm/d\theta$, and moisture content, M. Comstock, for example developed two equations for $dm/d\theta$. One for when M is greater than C and one for when M is less than C. The curves for both equations are straight lines that intersect at C, as shown in FIG. 2.

Figure 3:
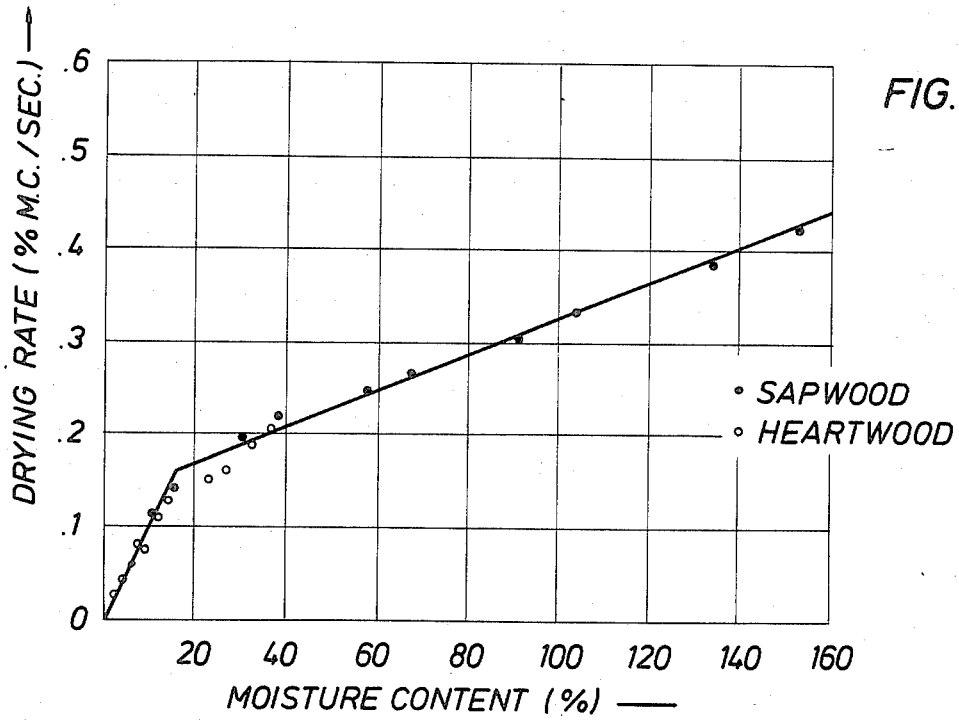
FIG. 3 is a drying rate curve for two $\frac{1}{8}$ inch Douglas Fir heartwood and two sapwood samples, air temperature 300° F. and air velocity 5,000 fpm; (after Comstock)

A study and transform of published data, however, indicated that actual drying rate vs. moisture content curves (FIGS. 3 and 5) and $\Delta T$ vs. moisture content curves (FIGS. 4 and 5) are of the form:

$$y=ax^b \tag{1}$$

FIGS. (2) and (3), for example, are transformations of data from South's paper for Douglas Fir and Southern Pine that follow equation (1) with remarkably high correlation thus confirming that thin veneer at least, does not exhibit the classical drying rate curve characterized by two linear portions, one constant and the other falling.

The following table shows the results of subjecting Comstock's data to a curve fit using Equation (1) as the model.

| Equation Number | Equation | Correlation $r^2$ | Drying Conditions |
|---|---|---|---|
| 2 | $-\frac{dm}{d\theta} = 0.021\ M^{0.59}$ | 0.96 | ⅛" Douglas Fir Drying Temperature 700° F. Air Velocity - 5000 fpm |
| 3 | $-\frac{dm}{d\theta} = 0.04\ M^{0.47}$ | 0.96 | 3/16" Douglas Fir Drying Temperature 400° F. Air Velocity - 5000 fpm |
| 4 | $M = [0.032\ \Delta T_1]^{2.97}$ | 0.99 | 3/16" Douglas Fir Drying Temperature 400° F. Air Velocity - 5000 fpm |

Equation (3) is for the rate of drying, $dm/d\theta$, vs moisture content, M curve. Equation (4) is for the moisture content, M, vs the difference between the temperature of the air and the wood, $\Delta T_1$.

Changing equation (3) to the general form for convenience gives:

$$-dM/d\theta=aM^b$$

Where:

a=0.04 b=0.47

Separation of variables and integration yields:

$$-\int_0^{M_1} dM/M^b = a\int_0^{\theta_1} d\theta \tag{4}$$

$$M_1 = -[(1-b)\,a\theta_1]^{1/(1-b)}$$

and similarly $$-\int_0^{M_2} dM/M^b = a\int_0^{\theta_2} d\theta \tag{5}$$

$$M_2 = -[(1-b)\,a\theta_2]^{1/(1-b)}$$

Subtracting:

$M_2-M_1$ and letting $^1/(1-b)=q$ gives $$M_2-M_1=-[(1-b)a]^q[\theta_2{}^q-\theta_1{}^q]$$

Since $\theta_1=L_1/S$ and $\theta_2=L_2/S$

Where:

$L_1$=Distance from dryer entrance to point where $M_1$ is measured, ft.

$L_2$=Distance from dryer entrance to point where $M_2$ is measured, i.e., dryer exit, ft.

S=Dyer speed, feet/min.

Substituting, gives:

$$M_2-M_1=-[(1-b)a]^q[L_2{}^q-L_1{}^q]1/S^q$$

Letting $[(1-b)a]^q[L_2{}^q-L_1{}^q]=C_2$=constant for given dryer $$M_2-M_1=C_2/S^q$$

Solving for $M_1$ gives:

$$M_1=M_2+C_2/S^q \tag{6}$$

Where:

$M_2$=Veneer Moisture Content at dryer exit, %.

$M_1$=Veneer Moisture Content at measuring point along the dryer lengths, $L_1$, %.

$\theta_2$=Elapsed drying time to reach final moisture content, $M_2$ at $L_2$, Sec.

$\theta_1$=Elapsed drying time to reach intermediate moisture content, $M_1$ at $L_1$, Sec.

Equation (6) gives the moisture content, $M_1$ at time $\theta_1$ in terms of the final drying time $\theta_2$ and the final moisture content $M_2$.

Equation (4) was derived from a fit of the moisture content, $M_1$, vs temperature difference between the drying medium and the veneer surface (FIG. (4)).

Changing equation (4) to the general form for convenience gives:

$$M_1=C_1(\Delta T_1)^P$$

Two independent equations (4) and (6) derived for the sample species, veneer thickness, and drying conditions now exist in terms of $M_1$. By equating equations (4) and (6), the very difficult to measure $M_1$ variable can be eliminated as follows:

$$M_1 = M_1 \quad (7)$$

Substituting $$M_2 + C_2/S^q = C_1(\Delta T_1)^P$$

Solving for $M_2$ gives:

$$M_2 = C_1(\Delta T_1)^P - C_2/S^q \quad (8)$$

Equation (8) relates the final moisture content to the dryer speed and the temperature difference between the veneer surface and the drying medium at any point along the dryer. $C_1$, $C_2$, P, and q are constants for a given measuring point, dryer and veneer.

Several attempts were made to use the relationship of equation 8 to control a wood veneer dryer, but measuring the temperature of the veneer in the dryer proved to be difficult. Infrared pyrometry was used. A certain amount of success was experienced; however, it was felt that for drying operations where the product is moving through an enclosed chamber, a more convenient measurement was required. This $\Delta T_1$ however, is easily obtained when drying paper and the like since the temperature of the product, $T_2$, of paper strip 10 as shown in FIG. 7 just as it moves out of contact with rotating drum 12, can be easily measured. Also, $T_1$, the temperature of the dryer surface can be readily measured.

Therefore, for use on wood veneer, fabric, pulp, and the like, equation (8) was modified by using a material and energy balance for a typical dryer section, FIG. 8, with necessary simplifying assumptions.

Where:

$T_i$=Temp. °F., heating medium prior to drying pass.

$T_o$=Temp. °F., heating medium after drying pass.

G=Mass rate, drying medium (Air+Vapor), #/min.

C=Specific heat of drying medium, Btu/#°F.

$q_w$=Rate of heat accumulation by wood, Btu/min.

$q_e$=Rate of heat required for evaporating water.

$\Delta T_2$=Temperature drop transversially or longitudinally in dryer.

Substituting into the balance equation and assuming that G and C do not vary appreciably especially near the dryer dry end gives:

$$[T_iGC - T_oGC] - [q_e + q_w] = 0 \quad (9)$$

$$GC_p[T_i - T_o] = q_w + q_e \quad (10)$$

Since $q_w + q_e$=Total heat added to dryer $q_t$, if shell losses are neglected, therefore $$GC[T_i - T_o] = q_t \quad (11)$$

Now using the well known heat transfer equation:

$$q_t = UA_s\Delta T_1 \quad (12)$$

Where:

$q_t$=total heat transferred

U=overall heat transfer coefficient $A_s$=heat transfer area of veneer-accounting for both sides of veneer $\Delta T_1$=heat transfer driving force for veneer; the temperature difference between veneer surface, $T_s$, and the hot air $T_i$, Substituting for $q_t$ in equation (11) above gives, $$GC[T_i - T_o] = UA_s[T_i - T_s] \quad (13)$$

Solving for $[T_i - T_s]$ gives:

$$[T_i - T_s] = \frac{GC}{UA_s}[T_i - T_o] \quad (14)$$

$[T_i - T_s]$ of equation (14) is equal to $\Delta T_1$ in equation (8) therefore by substituting equation (14) into equation (8) the drying equation is obtained in terms of the temperature difference across or along the dryer, $\Delta T_2$, which is quite easily obtained.

$$M_2 = C_1\left[\frac{GC}{UA_s}\right]^p [T_i - T_o]^p - \frac{C_2}{S^q} \quad (15)$$

Letting $C_1\left[\frac{GC}{UA_s}\right]^p = K_1$; $[T_i - T_o] = \Delta T_2$, and $C_2 = K_2$ then $$M_2 = K_1[\Delta T_2]^p - \frac{K_2}{S^q} \quad (16)$$

To determine if the $\Delta T_2$ signal across a dryer was of sufficient magnitude to drive a controller, thermocouples were place at various locations along a veneer jet dryer as shown in FIG. 9. Thermocouple 20 measures $T_1$, the temperature of the air before it contacts, the veneer (not shown) located in spaces 22, 23, 24, and 25 between jet tubes 26. Thermocouple measure $T_2$, the temperature of the air after it has contacted the veneer. The air is circulated by fan 28 and is heated by steam coils 29.

The results obtained indicated that $\Delta T_2$ was of sufficient magnitude for a control system.

Figure 1:
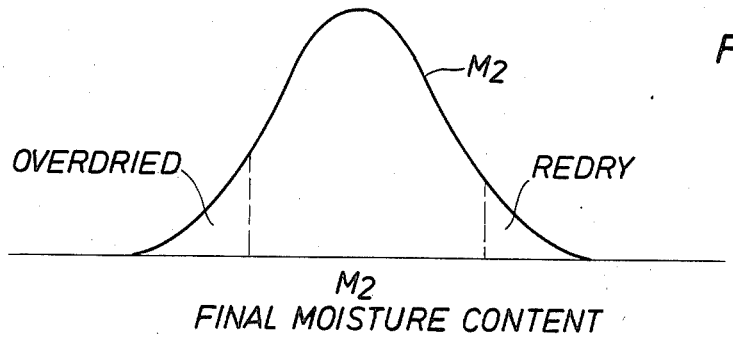
FIG. 1 is a graph of the typical variation in the moisture content of wood products leaving a dryer.

As stated above, the number of variables affecting veneer moisture content normally produce a product with a relatively wide variation in final moisture content, $M_2$, as shown in FIG. 1.

Common drying practice is to set as a target a tolerable percent of redry that will produce a minimum of over dried veneer. Variability of green veneer coupled with the lack of a good control system results in a significant amount of redry. This results in additional energy costs, reduced dryer capacity, and lower veneer quality. Obviously, if a successful control system could be devised, considerable savings would result.

A successful control system should reduce the deviation of final moisture values, $M_2$, and allow an increase in target final moisture content at the same or less percentage redry rate or a reduction in the percentage of redry at the same final moisture content. In either case the percentage of overdry dried veneer would be reduced resulting in improved quality.

Analyzing equation (16)

$$M_2 = K_1[\Delta T_2)^p - \frac{K_2}{S^q} \quad (16)$$

If the right hand of equation 16 could be held constant, moisture content variations in the veneer exiting the dryer should be at a minimum. This may be accomplished by manipulating the right hand side of equation 16.

For example, suppose the dryer control section is operating at steady state at a setpoint value of $M_2$ at time $t_0$. At time $t=t_1$, the veneer entering the control section is wetter. Since G, the mass of drying medium is essentially constant, $\Delta T_2$ will increase due to the cooling effect of this additional moisture. As $\Delta T_2$ increases, $M_2$ must increase also unless the right hand side of the equation is adjusted downward to compensate for the rise in $\Delta T_2$. To offset the $\Delta T_2$ rise, heat may be applied to the control section by either increasing nozzle velocity of the drying medium or opening the steam valve supplying the section. Additionally, the speed of the dryer, S, can be decreased to allow more drying time since decreasing S, dryer speed, increases the value of 1/S, which is a larger number subtracted from the $\Delta T_2$ term. If the veneer enters the control section at a lower moisture content than the setpoint requires, the opposite of the above is required. Thus, it is possible to control the final moisture content, $M_2$, within a narrower range by maintaining a constant value on the right hand side of equation (16) by varying the dryer speed and/or the heat input to the dryer.

The control system can be arranged in different way. For example, FIG. 10 is a horizontal sectional view of the last two sections of a dryer. Thermocouples 35 and 36 are located on each side of the last section of the dryer to measure $\Delta T_2$, the temperature drop of the hot air after a pass across the veneer. The $\Delta T_2$ signal is transmitted to recorder/controller 37. The controller index is positioned at a value corresponding to the desired final moisture content exiting the dryer. The difference between the index and the incoming $\Delta T_2$ signal generates a 4–20 ma signal that changes the speed of the dryer and adjusts the heat input to the dryer section. Thermocouples may be located in one or more dryer sections if required.

In FIG. 11 a more sophisticated system employing a small computer is shown schematically. Thermocouples 40 and 41 and 42 and 43 produce a voltage proportional to $\Delta T_2$, in the nth and N-1 sections of the dryer which are transmitted to computer 44 that continuously solves equation (16). In the control system described above, the value of exponents p and q were generally ignored. The computer, however, calculates a more accurate signal, since it can account for any possible nonlinearity of the terms $(\Delta T_2)^P$ and $(1/S^q)$, when $\Delta T_2$ and S vary. A feedback signal from a moisture meter on the dryer exit could also be used to adjust the set point for the desired final moisture, $M_2$, percent redry, or production rate. Additionally, the computer could be programmed to start up on any species or thickness and after a reasonable period of data gathering, calculate $K_1$, $K_2$, p and q by solving four simultaneous equations.

The invention has been described primarily as used with a veneer dryer. Nevertheless, the same control system can be used to control dryer for fiberboard, wallboard, hardboards, paper, pulp, cloth, or any fibrous or porous materials.

FIGS. 12, 13, and 14 are reproductions of strip charts upon which $\Delta T_2$ was recorded during actual drying operations. In FIG. 12, no control system was used except for monitoring of the veneer coming out of the dryer. $\Delta T_2$ varied widely and indicates that most of the veneer was dryer than necessary when compared to FIG. 13, which is the $\Delta T_2$ recorded for the same dryer and same veneer, but controlled in accordance with this invention.

When the control system of this invention is used with a longitudinal flow dryer where the air may move in opposition to or in the direction of the veneer flow as shown in FIG. 15, $\Delta T_2$ may be measured by thermocouples 46 and 47 positioned as shown or at intermediate points inbetween.

I claim:

1. A method of drying a product to a desired final moisture content in which the product being dried moves through the dryer at an adjustable speed while being contacted by a drying medium comprising the steps of moving the product through the dryer, measuring at a location in the dryer a differential temperature, ($\Delta T$), that relates to the difference between the temperature of the drying medium and that of the product to determine at that time and at the speed of the dryer at that time what the final moisture content of the product will be, and controlling the equilibrium value of $\Delta T$ by varying one of the components of $\Delta T$ and the speed of the product through the dryer to obtain the desired final moisture content in the product.

2. The method of claim 1 in which the drying medium is heated air and ($\Delta T$) is the difference between the temperature of the air before it contacts the product and the temperature of the air after it has moved out of contact with the product.

3. The method of claim 1 in which the drying medium is a heated drum and ($\Delta T$) is the difference between the temperature of the drum and the temperature of the product as it moves out of contact with the drum.

4. A method of drying wood products to a desired final moisture content comprising the steps of moving the wood products at a preselected speed through a dryer through which heated air is circulated, measuring the difference between the temperature of the air coming into the dryer ($T_i$) and the temperature of the air leaving the dryer, ($T_o$) and varying the temperature of the incoming air and the speed of travel of the product to obtain the desired final moisture content, continuously measuring the temperature difference between the inlet and outlet air, and continuously adjusting the temperature of the incoming air and the speed of travel of the product as required to maintain the final moisture content of the dried product within an acceptable range in accordance with the equation $$M = K_1 \Delta T^p - \frac{K_2}{S^q},$$

where

M = final moisture content $\Delta T = T_i - T_o$, and

S = speed of travel of the product through the dryer, and $K_1$, $K_2$, p, and q are constants for a given dryer and product.

5. Apparaus for controlling a dryer of wood products to dry the wood products to a final moisture content that is within an acceptable range having a conveyor for moving the products through the dryer and means for moving heated air over the products, said apparatus comprising means for measuring the difference between the temperature of the air before the drying pass $T_i$ and the temperature of the air after the drying pass, $T_o$, and means for varying the temperature of the incoming air and speed to maintain the final moisture content of the dried wood product within an acceptable range in accordance with the equation $$M = K_1 \Delta T^p - \frac{K_2}{S^q},$$

where

M=final moisture content $\Delta T = T_i - T_o$, and

S=speed of travel of the product through the dryer, and $K_1$, $K_2$, p, and q are constants for a given dryer and product.

6. A method of controlling a product dryer at a temperature above that of the product to raise the temperature of the product to dry the product to a desired final moisture content in which the product being dried moves through the dryer while being contacted by a drying medium comprising the steps of moving the product through the dryer at a preselected speed, measuring the temperature of the drying medium before it contacts the product and the temperature of the drying medium after it contacts the product, at a selected location in the dryer, calculating what the final moisture content of the product will be from the equation $$M_2 = K_1 (\Delta T_2)^p - \frac{K_2}{S^q}$$

where:

$M_2$=the final moisture content of the product, $\Delta T_2 = T_i - T_o$ where $T_i$=temperature of drying medium prior to drying pass and $T_o$=temperature of drying medium after drying pass;

$S = L/\Delta\theta$ where L=distance from the location of the measurement to the dryer exit, and $\Delta\theta$=drying time remaining at measuring location;

$$K_1 = C_1 \left[ \frac{GC}{UA_s} \right]^p$$

where $C_1$=a constant determined empirically for the particular product and dryer;

G=mass rate of drying medium (air+$H_2O$), lbs/minute;

C=specific heat of drying medium, BTU/#°F.;

U=Overall heat transfer coefficient

As=heat transfer area of the product (both sides), sq. ft.

p, $K_2$ and q=constants determined empirically for the particular product and dryer, and adjusting at least one of the speed of travel of the product and ($\Delta$T) to obtain the desired final moisture content of the product.

7. A method of drying a product to a desired final moisture content in which the product being dried moves through the dryer at an adjustable speed (S) while being contacted by a drying medium comprising the steps of moving the product through the dryer, measuring at a location in the dryer a differential temperature, ($\Delta$T), that relates to the difference between the temperature of the drying medium and that of the product, calculating what the final moisture content (M) of the product will be using the equation $$M = \Delta T - 1/S$$

and controlling at least one of the value of ($\Delta$T) or the speed of the product through the dryer to obtain the desired moisture content in the product.

8. The method of claim 7 in which the drying medium is heated air and ($\Delta$T) is the difference between the temperature of the air before it contacts the product and the temperature of the air after it has moved out of contact with the product.

9. The method of claim 7 in which the drying medium is a heated drum and ($\Delta$T) is the difference between the temperature of the drum and the temperature of the product as it moves out of contact with the drum.

10. A method of drying products such as wood to a final moisture content within an acceptable range comprising the steps of moving the products at a preselected speed (S) through a dryer in which heated air is circulated, continuously measuring the difference between the temperature of the air before it contacts the product ($T_i$) and the temperature of the air after it has contacted the product, ($T_o$) continuously calculating what the final moisture content (M) will be using the equation $$M = \Delta T - 1/S$$

and continuously adjusting the temperature of the incoming air and the speed of travel of the product as required for the final moisture content of the dried product to be within the acceptable range.

* * * * *